United States Patent [19]

Feher

[11] Patent Number: 5,077,709

[45] Date of Patent: Dec. 31, 1991

[54] ROTATING TIMEPIECE DIAL FACE CONSTRUCTION WITH INCLUDED MOVABLE DECORATIVE OBJECTS

[76] Inventor: Steve Feher, 1909 Aleo Pl., Honolulu, Hi. 96822

[21] Appl. No.: 597,017

[22] Filed: Oct. 15, 1990

[51] Int. Cl.[5] ..... G04B 19/06

[52] U.S. Cl. ..... 368/229; 368/228; 368/76; 368/77; 368/80

[58] Field of Search ..... 368/294–296, 368/221–239, 76, 77, 80

[56] References Cited

U.S. PATENT DOCUMENTS 1,850,184 3/1932 Spainhower ..... 368/229

FOREIGN PATENT DOCUMENTS 0343324 1/1960 Switzerland ..... 368/294

2125991 3/1984 United Kingdom ..... 368/229

*Primary Examiner*—Bernard Roskoski

*Attorney, Agent, or Firm*—George J. Netter

[57] ABSTRACT

A disklike ornamental timepiece dial face (12) is constructed of transparent material forming an enclosed chamber (24) and a central clearance (28). Decorative materials (32) are located within the chamber and provide a kinetic display on movement of the timepiece. A second version, provides a motor (58) which rotates the ornamental dial face (12) to induce a continuous kinetic display.

5 Claims, 1 Drawing Sheet

ROTATING TIMEPIECE DIAL FACE CONSTRUCTION WITH INCLUDED MOVABLE DECORATIVE OBJECTS

BACKGROUND OF THE INVENTION

1. Field of the Invention

The present invention relates generally to timepieces such as clocks and watches, and, more particularly, to a dial face for a timepiece which is kinetically decorative while not interfering with the normal function as a timepiece.

2. Description of Related Art

Clocks, watches and other timepieces, in addition to serving their primary function of providing a time display, also frequently include a dial depicting a great variety of different scenes or settings. One other form of ornamentation has consisted in providing a transparent background for the watch face so that the works of the watch are visible.

SUMMARY OF THE INVENTION

It is accordingly a primary aim and object of the present invention to provide a timepiece dial face which has ornamental parts that move responsive to movement of the timepiece.

In accordance with a first embodiment of the present invention, a disklike ornamental dial face is provided constructed of transparent synthetic plastic or glass with a generally disklike chamber arranged about a central clearance hole. The enclosed chamber of the dial face is provided with such materials as mercury or gold dust in light oil, as well as various solid objects (e.g., replicas of watch gears or other mechanical devices). The drive shaft for the timepiece extends through the central opening and the hands mounted thereon are spaced outwardly from the outer surface of the dial face which will occasionally be referred to herein as a bubble face. A second dial face may be located underneath the bubble face and includes, for example, typical markings identifying the hours (and minutes) of the day.

With the described timepiece when made into the form of a watch, motion of the hand or arm produces a kinetic display of the materials contained within the bubble face, all of which is accomplished without interfering with the functioning of the watch to tell time.

In a second version of the invention, the clock is situated in a fixed location, such as a wall clock, for example. As in the first embodiment a first dial face is provided having ornamental parts which can move about within a transparent bubble. Since the clock in this case is not typically subject to motion, the circumferential edge of the bubble dial face is driven by a low speed motor which induces the desired kinetic art display in the dial face. A further dial face located below the ornamental one may contain time telling indicia.

DESCRIPTION OF A PREFERRED EMBODIMENT

Figure 1:
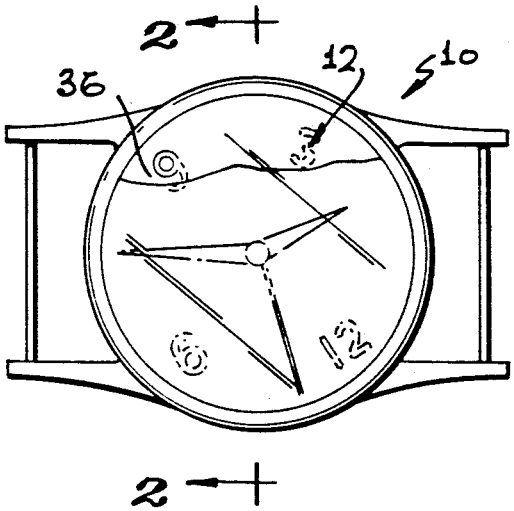
FIG. 1 is a front elevational view of a watch having a dial face of the present invention.

With reference now to the drawing and particularly FIG. 1, a watch 10 is shown which incorporates the special bubble watch face 12 of the present invention. As will be more particularly described, the bubble watch face includes various liquid, powdered and/or miniature mechanical parts or other decorative items which provide a kinetic ornamental display responsive to ordinary movement of the hand and arm of one wearing the watch. The kinetic display is achieved without interfering with the normal operation of the watch as a timepiece.

Figure 2:
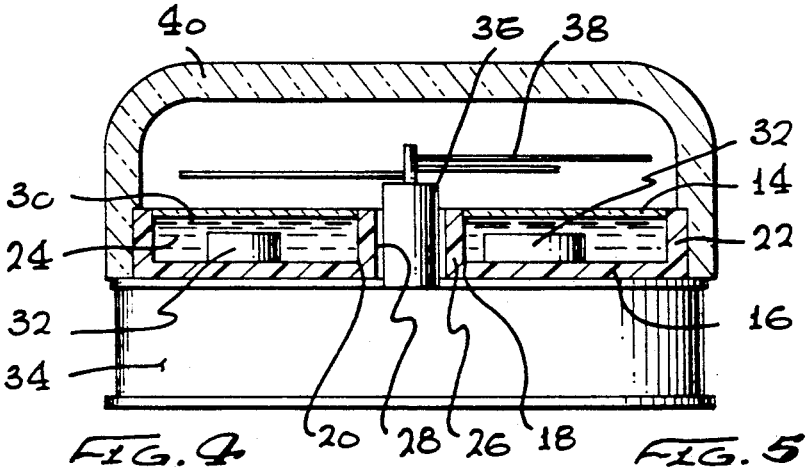
FIG. 2 is a sectional view taken along line 2—2 in FIG. 1.

As can be seen best in FIG. 2, the bubble watch face is of generally cylindrical disklike geometry having identical upper and lower circular plates 14 and 16, each of which has a central axially located clearance opening 18 and 20, respectively. The two circular plates are held in opposed spaced apart relation by a band-like circumferentially extending edge wall 22 which sealingly engages the peripheral edges of the two plates enclosing a cylindrical chamber 24. A tube section 26 of appropriate dimensions extends along the two clearance openings 18, 20 and is sealingingly affixed to the two plates in order to provide a single passage 28 extending through the center points of the two plates.

The bubble dial face 12 is constructed preferably of a transparent and clear glass or synthetic plastic which is free from blurred portions, especially in the plates so that normal viewing may take place through the dial face. Optionally, the two plates may be constructed of a transparent glass or synthetic plastic and the tube 26 for the clearance passage, as well as the band-like edge wall 22 may be constructed of an opaque material such as a metal, for example.

Prior to final assembly of the bubble watch face, a quantity of a liquid for example, may be provided to the interior of the member as shown in FIG. 2 almost, but not quite filling the chamber 24 and, instead, leaving a slight space 30. Next, one or more ornamental objects 32 can be located in the bubble fluid, which objects are of such dimensions so as not to contact both of the plates 14 and 16 at the same time. In this way the objects can readily move about in the liquid and not become wedged between the plates. Also, it is important that the dimensions of the objects 32 are such that they cannot jam together between the two plates, nor can they rotate to a position so as to jam.

Optionally, instead of using a liquid, fine gold dust may be located in light oil to replace the fluid with objects. Still further, mercury located within a light oil gives a pleasing and interesting kinetic ornamentation on movement.

A watch drive mechanism 34 is of conventional construction and can include a further dial face 36 with hour and minute indications thereon. The drive shaft 38 for the watch hands extends centrally upwardly from the clock mechanism 34 and the bubble dial face 12 has its central passage 28 located onto the drive shaft. By use of a small quantity of adhesive (not shown) the bubble dial face is secured to the watch dial 36 and the hands 38 are secured to the outer end of the drive shaft following which the watch crystal 40 is positioned over the hands and dial in conventional manner.

Figure 3:
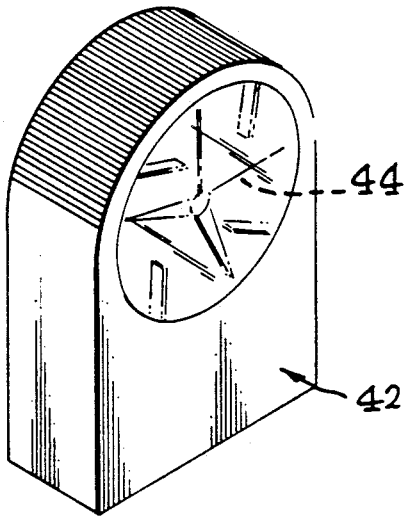
FIG. 3 shows the invention incorporated into a table clock.
Figure 4:
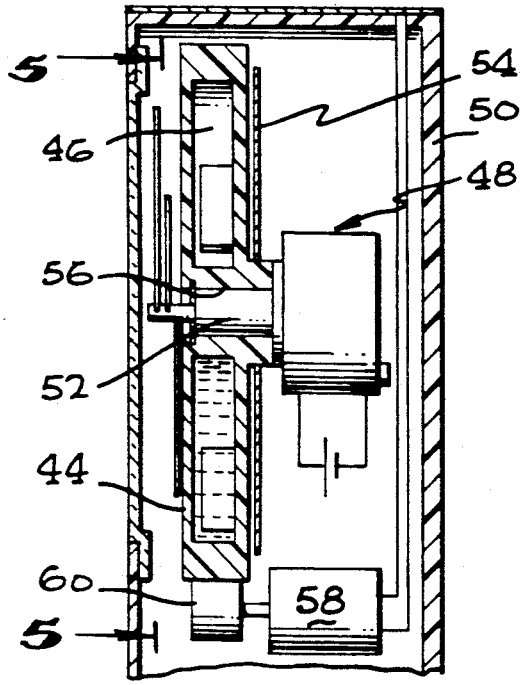
FIG. 4 is a sectional view of a timepiece with a driven ornamental dial face.
Figure 5:
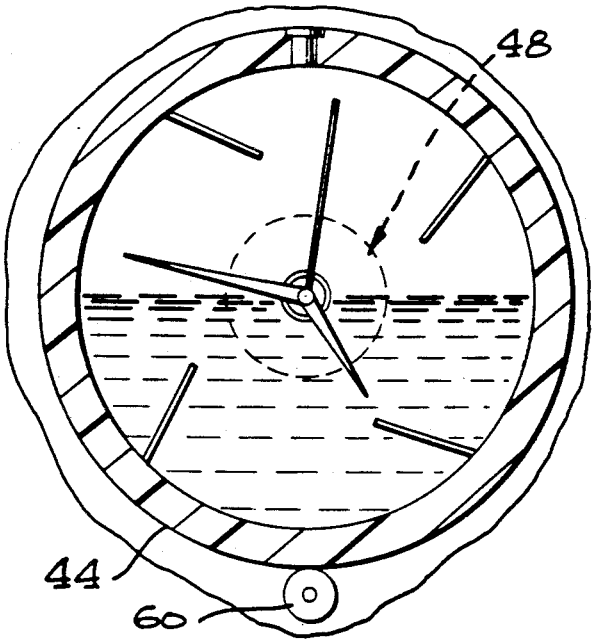
FIG. 5 is a front elevational, sectional view along line 5—5 in FIG. 4.

For the ensuing description of a further embodiment of the invention reference is now made simultaneously to FIGS. 3-5. A clock 42 which is contemplated for resting or hanging disposition is also provided with a bubble dial face 44 of identical construction to the dial face 12 except that it is of a larger size. The internal chamber 46 is filled with a liquid fine oil, objects, gold dust or mercury as in the first embodiment.

As seen best in FIG. 4, the clock mechanism 48 mounted within the clock housing 50 has a drive shaft 52 that extends through a central opening in a conventional dial face 54 having hours and minutes indicia and then through a central opening 56 in the bubble dial face 44.

In addition, a low speed motor 58 frictionally drives the bubble dial face 44 in a circular path about the shaft 52 via a roller 60 that contacts the bubble face dial edge. In this way, motion is given to the bubble face dial 44 in order to achieve the kinetic ornamentation effect desired.

I claim:

1. A timepiece dial face construction, comprising:

means for indicating time; outer dial face body, including first and second transparent sheetlike members edge sealed in spaced apart relation forming a chamber, and tube section means extending through a central portion of the first and second transparent sheetlike members and sealed to each, said tube means being for receiving a timepiece drive shaft for the timepiece hands which are to be located in front of the outer dial face body;

object means loosely located within the chamber for independent movement as the timepiece is moved;

and means for rotatively driving the outer dial face body about the drive shaft.

2. A timepiece dial face construction as in claim 1, in which there is further provided an inner dial face located behind the outer dial face bearing time indicia.

3. A timepiece dial face construction as in claim 1, in which the means for rotatively driving includes an electric motor and a roller driven thereby which roller contacts an edge of the dial face body.

4. A timepiece dial face construction in claim 1, in which the object means includes a fluid and a plurality of individual solid objects.

5. A timepiece dial face construction as in claim 1, in which the object means includes a fluid and a pulverulent material.

* * * * *